US006801206B2

(12) United States Patent
Poimboeuf et al.

(10) Patent No.: US 6,801,206 B2
(45) Date of Patent: Oct. 5, 2004

(54) METHOD AND APPARATUS FOR VIRTUALIZED OPERATOR PANEL

(75) Inventors: Joshua Nathan Poimboeuf, Austin, TX (US); Paul Nguyen, Austin, TX (US); Sayileela Nulu, Austin, TX (US); Steve Xu, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 332 days.

(21) Appl. No.: 09/798,285

(22) Filed: Mar. 1, 2001

(65) Prior Publication Data

US 2002/0124151 A1 Sep. 5, 2002

(51) Int. Cl.[7] ..... G09G 5/36

(52) U.S. Cl. ..... 345/556; 345/544; 711/153; 711/173

(58) Field of Search ..... 345/556, 544; 712/13; 711/173, 129, 153, 147, 170

(56) References Cited

U.S. PATENT DOCUMENTS 5,752,068 A * 5/1998 Gilbert
5,881,311 A * 3/1999 Woods
6,438,586 B1 * 8/2002 Hass et al.

* cited by examiner

*Primary Examiner*—Matthew C. Bella
*Assistant Examiner*—Hau Nguyen
(74) *Attorney, Agent, or Firm*—Sawyer Law Group LLP

(57) ABSTRACT

A method and apparatus for providing a computer system having a plurality of logical partitions with a virtual operator panel is disclosed. The method and apparatus include displaying a plurality of operator panels on a single console corresponding to each of the logical partitions, and providing a buffer for each logical partition. The status codes from each of the logical partitions are then written directly to the corresponding buffer. To display the status codes of one of the logical partitions, the status code from the buffer corresponding the logical partition is read and sent to the corresponding operator panel for display.

22 Claims, 1 Drawing Sheet

METHOD AND APPARATUS FOR VIRTUALIZED OPERATOR PANEL

FIELD OF THE INVENTION

The present invention relates to multiprocessor computer systems, and more particularly to providing a logical partition multiprocessor computer system with a virtual operator panel.

BACKGROUND OF THE INVENTION

Logical partitioning is the ability to make a single multiprocessing system run as if it were two or more independent systems. Each logical partition represents a division of resources in the system and operates as an independent logical system. Each partition is logical because the division of resources may be physical or virtual. An example logical partitions is the partitioning of a multiprocessor computer system into multiple independent servers, each with it own processors, main storage, and I/O devices.

A large computer system typically includes an operator panel that is capable of displaying status codes of the system, such as progress codes and error codes. When a multiprocessor computer system has been logically partitioned, an operator needs to be able to view the status of each logical partition, but there is only one physical console for displaying the operator panel for the system.

Accordingly, what is needed is a method and apparatus for displaying the status codes for each of the logical partitions without using multiple physical displays. The present invention addresses such a need.

SUMMARY OF THE INVENTION

The present invention provides a method and apparatus for providing a computer system having a plurality of logical partitions with a virtual operator panel. The method and apparatus include displaying a plurality of operator panels on a single console corresponding to each of the logical partitions, and providing a buffer for each logical partition. The status codes from each of the logical partitions are then written directly to the corresponding buffer. To display the status codes of one of the logical partitions, the status code from the buffer corresponding the logical partition is read and sent to the corresponding operator panel for display.

Accordingly, the present invention provides the logical partitions with the ability to display their status codes through one physical console. Thus, the operator may maintain the entire system from one interface instead of having to use multiple displays and keyboards.

DESCRIPTION OF THE INVENTION

Figure 1:
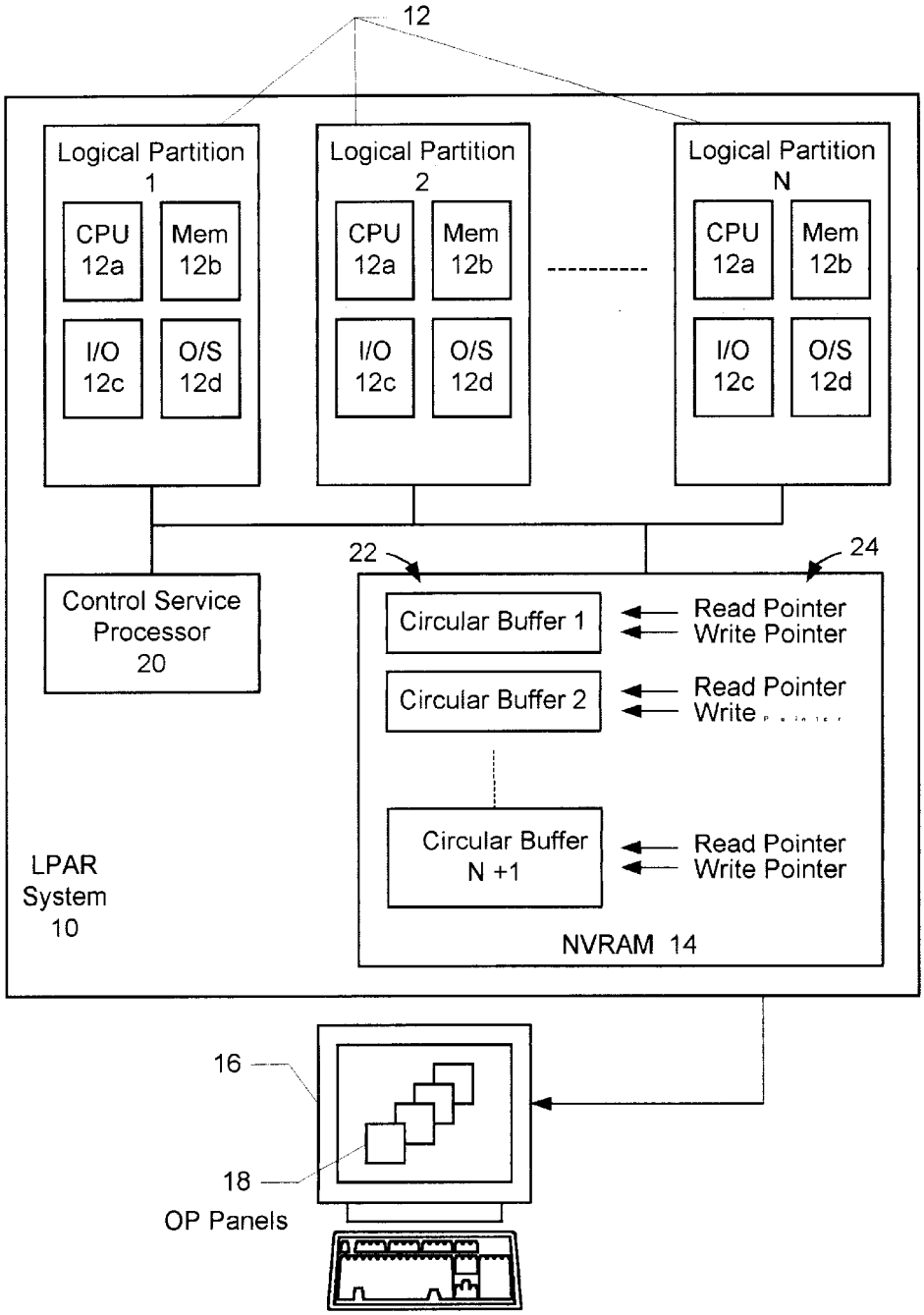
FIG. 1 is a block diagram illustrating a logical partition (LPAR) computer system having a virtual operator panel in accordance with a preferred embodiment of the present invention.

The present invention relates to providing a logical partition computer system with a virtual operator panel. The following description is presented to enable one of ordinary skill in the art to make and use the invention and is provided in the context of a patent application and its requirements. Various modifications to the preferred embodiments will be readily apparent to those skilled in the art and the generic principles herein may be applied to other embodiments. Thus, the present invention is not intended to be limited to the embodiments shown but is to be accorded the widest scope consistent with the principles and features described herein.

FIG. 1 is a block diagram illustrating a logical partition (LPAR) computer system having a virtual operator panel in accordance with a preferred embodiment of the present invention. The system 10 includes multiple logical partitions 12, and a nonvolatile random access memory (NVRAM) 14. Each logical partition 12 has its own processor(s) 12*a*, memory 12*b*, and I/O devices 12*c*, and may run its own operating system 12*d* independently of the other logical partitions 12. In a preferred embodiment, the system 10 may have up to sixteen logical partitions 12. The system 10 also includes a nonvolatile random access memory (NVRAM) 14 that is accessible by the logical partitions 12 as well as a control service processor 20.

The LPAR system 10 is coupled to an external console 16, which is used to display an operator panel 18. In a preferred embodiment, the console 16 may be implemented using a conventional PC running the Linux™ operating system. In order to maintain the logical partitions 12, an operator needs to view the status codes of each of the logical partitions 12. As shown, however, the LPAR system 10 only has one console 16.

In order to solve this problem, the present invention virtualizes the operator panel 18 by providing the console 16 with appropriate application software for displaying a plurality of operator panels 18 corresponding to each of the logical partitions and allowing each of the logical partitions 12 to display their status codes in the corresponding operator panel 18. This is accomplished by providing a buffer in the NVRAM 14 for each logical partition 12. Then, instead of writing the status codes from each logical partition 12 directly to the console 16, each logical partition 12 writes its own status codes to the corresponding buffer in the NVRAM 14. When an operator types a command on the console 16 to display the status of a particular logical partition 12, the CSP 20 reads the status codes out of the buffer corresponding to the logical partition 12 and sends the status codes to the corresponding operator panel 18 for display.

In accordance with a preferred embodiment of the present invention, the buffers are implemented as circular buffers 22 where each of the circular buffers includes a plurality of positions for storing the status codes. An additional global circular buffer 22 may also be provided, for a total of N+1 buffers 22, where N represents the number of logical partitions 12. Each of the circular buffers 22 includes a pair of pointers 24, a read pointer and a write pointer, that are used when data is read from, and written to, the circular buffers 22.

In operation, when the CSP 20 or a logical partition 12 needs to write data to one of the circular buffers 22, the write pointer is used as an index to the current write position within the buffer 22. After data is written into the current write position within the buffer 22, the CSP 20 or the logical partition 12 increments the write pointer. If more than one status code is written to the buffer 22 during the write operation, then the write pointer is incremented equal to the number of status codes written into the buffer 22.

During a read operation, the corresponding write and read pointers 24 are examined to determine the current read position within the buffer 22. If the write and read pointers 24 are equal, then the last status code written into the buffer 22 has already been read the buffer 22. If the write and read pointers 24 are not equal, then the status codes written into positions between the write and read pointers must be read from the buffer 22. For example, if the write pointer points to position four in the buffer 22, and the read pointer points to position zero, then the status codes from positions zero through four must be read from the buffer 22 and sent to the operator panel 18 for display. After a read operation, the read pointer is incremented equal to the number of status codes read from the buffer 22.

A method and apparatus for providing a logical partition computer system with a virtual operator panel has been disclosed. Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A logical partition (LPAR) computer system running a plurality of logical partitions, comprising:

console means coupled to the computer system for displaying a plurality of operator panels corresponding to each of the logical partitions;

a buffer for each of the logical partitions, means for writing the status code from each logical partition directly to the corresponding buffer, and means for sending the status codes from each of the buffers to the operator panel of the corresponding logical partition for display.

2. The LPAR system of claim 1 wherein each other buffers comprise a circular buffer that contain a plurality of positions for storing status codes.

3. The LPAR system of claim 2 wherein each of the circular buffers is provided with a pair of pointers, a read pointer and a write pointer.

4. The LPAR system of claim 3 wherein the write pointer is used as an index to a current write position within the circular buffer when a status code needs to be written into one of the circular buffers.

5. The LPAR system of claim 4 wherein the write pointer is incremented after the status code is written into the current write position within the circular buffer.

6. The LPAR system of claim 5 wherein the write pointer is incremented equal to the number of status codes written into the buffer if more than one status code is written into the circular buffer during a write operation.

7. The LPAR system of claim 6 wherein when a status code is to be read from the circular buffer, the read and write pointer is for the buffer are compared, and if the read and write pointers are equal, then it is determined that the last status code written into the circular buffer has already been read from the circular buffer, and wherein if the write and read pointers are not equal, then the status codes written into positions between the write and read pointers in the circular buffer are read.

8. A method for providing a computer system having a plurality of logical partitions with a virtual operator panel for displaying status information from each of the logical partitions, the method comprising the steps of:

(a) displaying a plurality of operator panels on a single console corresponding to each of the logical partitions;

(b) providing a buffer for each logical partition;

(c) writing status codes from each of the logical partitions directly to the corresponding buffer; and (d) sending the status codes from each of the buffers to the operator panel of the corresponding logical partition for display.

9. The method of claim 8 wherein step (b) further includes the step of providing a circular buffer for each of the logical partitions in nonvolatile memory, each of the circular buffers including a plurality of positions for storing status codes.

10. The method of claim 9 wherein step (b) further includes the step of providing each of the circular buffers with a pair of pointers, a read pointer and a write pointer.

11. The method of claim 10 wherein step (c) further includes the step of: when a status code needs to be written into one of the circular buffers, using the write pointer as an index to a current write position within the circular buffer.

12. The method of claim 11 wherein step (c) further includes the step of incrementing the write pointer after the status code is written into the current write position within the circular buffer.

13. The method of claim 12 wherein step (c) further includes the step of: if more than one status code is written to the circular buffer during the write operation, then incrementing the write pointer equal to the number of status codes written into the buffer.

14. The method of claim 13 wherein step (d) further includes the steps of:

(i) comparing the read and write pointers for the buffer, (ii) determining that the last status code written into the circular buffer has already been read the circular buffer when the write and read pointers are equal, and (iii) if the write and read pointers are not equal, then reading the status codes written into positions between the write and read pointers from the buffer.

15. A computer-readable medium containing program instructions for providing a computer system having a plurality of logical partitions with a virtual operator panel for displaying status information from each of the logical partitions, the instructions for:

(a) displaying a plurality of operator panels on a single console corresponding to each of the logical partitions;

(b) providing a buffer for each logical partition;

(c) writing status codes from each of the logical partitions directly to the corresponding buffer; and (d) sending the status codes from each of the buffers to the operator panel of the corresponding logical partition for display.

16. The computer readable medium of claim 15 wherein instruction (b) further includes the instruction of providing a circular buffer for each of the logical partitions in nonvolatile memory, each of the circular buffers including a plurality of positions for storing status codes.

17. The computer readable medium of claim 16 wherein instruction (b) further includes the instruction of providing each of the circular buffers with a pair of pointers, a read pointer and a write pointer.

18. The computer readable medium of claim 17 wherein instruction (c) further includes the instruction of: when a status code needs to be written into one of the circular buffers, using the write pointer as an index to a current write position within the circular buffer.

19. The computer readable medium of claim 18 wherein instruction (c) further includes the instruction of incrementing the write pointer after the status code is written into the current write position within the circular buffer.

20. The computer readable medium of claim 19 wherein instruction (c) further includes the instruction of: if more than one status code is written to the circular buffer during the write operation, then incrementing the write pointer equal to the number of status codes written into the buffer.

21. The computer readable medium of claim 20 wherein instruction (d) further includes the instructions of:

(i) comparing the read and write pointers for the buffer, (ii) determining that the last status code written into the circular buffer has already been read the circular buffer when the write and read pointers are equal; and (iii) if the write and read pointers are not equal, then reading the status codes written into positions between the write and read pointers from the buffer.

22. A logical partition (LPAR) computer system, comprising:

a plurality of logical partitions, each running independently from the other logical partitions;

a nonvolatile memory accessible by each of the logical partitions; and a console coupled to the computer system for displaying a plurality of operator panels corresponding to each of the logical partitions for displaying status codes from each of the logical partitions by, providing a buffer in the nonvolatile memory for each of the logical partitions, writing the status code from each logical partition directly to the corresponding buffer in the nonvolatile memory, and sending the status codes from each of the buffers to the operator panel of the corresponding logical partition for display.

* * * * *